US005738727A

United States Patent [19]

Cebola et al.

[11] Patent Number: 5,738,727

[45] Date of Patent: Apr. 14, 1998

[54] DEVICE FOR ELECTROSTATIC SPRAYING OF A COATING PRODUCT

[75] Inventors: Dominique Cebola, Voiron; Eric Prus, Grenoble; Caryl Thome, Saint-Egreve, all of France

[73] Assignee: Sames S.A., France

[21] Appl. No.: 618,836

[22] Filed: Mar. 20, 1996

[30] Foreign Application Priority Data

Mar. 20, 1995 [FR] France ..... 95 03447

[51] Int. Cl.[6] ..... B05B 5/025

[52] U.S. Cl. ..... 118/631; 118/629; 118/634; 239/694

[58] Field of Search ..... 118/629, 621, 118/620, 631, 630, 634; 239/690, 695, 694, 690.1

[56] References Cited

U.S. PATENT DOCUMENTS 5,169,673 12/1992 Demeny et al. .
5,238,709 8/1993 Wilkie .
5,332,162 7/1994 Peck et al. .
5,500,045 3/1996 Ehinger et al. .

FOREIGN PATENT DOCUMENTS 0404344 12/1990 European Pat. Off. .
0510938 10/1992 European Pat. Off. .
2703265 10/1994 France .
2703266 10/1994 France .
9014894 12/1990 WIPO .

*Primary Examiner*—Donald E. Czaja
*Assistant Examiner*—Calvin Padgett
*Attorney, Agent, or Firm*—Loeb & Loeb LLP

[57] ABSTRACT

An electrostatic coating product spraying device comprising: at least one sprayer having an electrostatic charging mechanism; and a support structure supporting the at least one sprayer, the structure including elements which are at ground potential, wherein the support structure includes an electrostatic shield positioned and arranged so that the electrostatic charging mechanism is located between the electrostatic shield and an object to be coated. The electrostatic shield is maintained at a potential differing from ground potential.

15 Claims, 4 Drawing Sheets

DEVICE FOR ELECTROSTATIC SPRAYING OF A COATING PRODUCT

BACKGROUND OF THE INVENTION

The invention concerns a device for electrostatic spraying of a coating product. Such a device can essentially consist of a roof machine or a lateral machine utilized in an installation for coating automotive vehicle bodies.

In devices known in the prior art, one or several sprayers of the coating product are carried by a structure such as the beam of a roof machine or the arm of a lateral machine. As disclosed in French Patent FR-A-2703266, and counterparts U.S. application Ser. No. 08/530,206 and WO 94/22590, in order to limit the consumption of coating product and of cleaning product during change of products, it has appeared to be useful to install coating product changing blocks close to the sprayers. This implies incorporating into the support structure for the sprayers control and/or measurement elements such as electric valves or flow rate cells. These elements function at ground potential and cannot be exposed to high voltage. In addition, electric motors are necessary to assure movement of the sprayers such as the sweeping movement of the sprayers of a roof machine, the movement of the wrist of a lateral machine or the displacement of a metering piston. These motors and their control elements must also remain at ground potential. In addition, the displacement guiding elements of the projector or projectors, such as rails, bearings or rollers are in general of metal and must be maintained at ground potential. In effect, if these conductive bodies were left at a floating potential, they would become electrically charged, by "tracking" phenomena or electromagnetic influence charge, which would be dangerous. In addition, these metallic objects could constitute, step by step, a discharge path of the generator which would then no longer be capable of charging the coating product cloud, or mist.

Now, the principle of an electrostatic coating device requires that the coating product be brought to a high voltage during its spraying toward the object to be coated. In order to achieve insulation between the objects which must remain at ground potential and the sprayer brought to a high voltage or the external electrodes which can be utilized in the case of Corona discharge, it has been proposed in French Patent FR-A-2703265, and counterpart U.S. application Ser. No. 08/220,675, now U.S. Pat. No. 5,000,045 to utilize a carrying structure having an insulating frame. As a result, the entirety of the support structure and the objects which it encloses remain at ground potential. According to another approach, it is possible to utilize a beam having a conductive structure, for example metallic, maintained at ground potential. In the two cases, there remains however a problem of soiling of the support structure.

In effect, in taking the example of a rotary coating product sprayer which is charged internally, the charging electrode is constituted by an atomizing bowl of the sprayer. The electric field lines thus proceed from the edge of the bowl toward objects situated in its vicinity, which objects are at a different potential than the bowl. These objects essentially include the object to be coated, for example a vehicle body, and the support structure. The distance between the sprayer and the object to be coated is of the order of 250–300 mm; it cannot be reduced for reasons of safety and uniformity of the spray. The distance between the atomization bowl and the support structure is of the same order of magnitude. Thus, the electrostatic field lines will be closed substantially in the same manner on the object to be coated and on the parts of the support structure which are at ground potential. The atomized particles leaving the bowl will thus be attracted by the support structure. It is true that aerodynamic forces can serve to give a preferred direction to the cloud of particles emitted from the projector but zones of turbulence exist, in particular due to movements of the support structure and the "ventilator" effect of the atomizing bowls. It thus appears that a part of the coating product particles has a tendency to be deposited on the support structure.

Certain coating devices are furnished with counter-electrodes mounted in proximity to the sprayer or sprayers and on the associated support structure. Such counter-electrodes have a tendency to become soiled because they disturb the flow of air around the projector or projectors and are exposed to a vortex of paint particles. In addition, the electrostatic field between the counter-electrodes and the support structure is oriented in such a manner that it entrains coating product particles toward the support structure, i.e. away from the objects to be coated.

All of these shortcomings lead to an excess consumption of coating product, since the product which is thus lost is not deposited on vehicle bodies. In addition, there is obtained a coating quality which is sometimes unacceptable because large drops of coating product can drop from the support structure. Finally, a soiling of the structure is observed, which necessitates extensive and difficult manual maintenance operations, requiring regular production halts.

SUMMARY OF THE INVENTION

A primary object of the present invention is to resolve the totality of these problems.

The above and other objects are achieved, according to the invention by an electrostatic spraying device comprising a structure supporting at least one sprayer, which structure includes components at ground potential, wherein the structure comprises an electrostatic shield at an electric potential different from ground.

With the device according to the invention, the support structure appears, electrostatically and from the spraying point of view, as an object at high voltage and the particles leaving the sprayer are no longer attracted toward this object. The field lines close uniquely on the object to be coated and the electrostatic effect is clearly beneficial to the spraying.

According to a particularly advantageous embodiment of the invention, the electrostatic shield is brought to a potential at least equal in absolute value to that of the charging electrode or of the atomization bowl in the case of a rotary sprayer with internal electrostatic charging. Thus, the coating product particles leaving the sprayer are not only attracted to the object to be coated but are repelled by the support structure.

According to preferred embodiments, the electrostatic shield can be constituted by a metal plate or screen connected to a high voltage generator and covered with an insulating layer in order to not transmit the high voltage to nearby objects which must permanently remain at ground potential and thus to not short circuit the associated high voltage generator of the device. It can also be a matter of one or several electric cables disposed substantially in a loop or a serpentine and forming a Faraday cage. The electrostatic effect is the same as with a plate. The shield can also be formed from tubes made of a plastic material and containing a mass of conductive liquid placed at high voltage. Alternatively, the tube, or tubes, in question can be replaced by a bundle of small diameter tubes capable of being bent to a smaller radius of curvature. Finally, the shield can be obtained by metallization of a part of the support structure, the metallized part being covered with an insulating varnish or other insulating covering.

BRIEF DESCRIPTION OF THE DRAWING

The invention will be better understood and other advantages thereof will appear more clearly from the description that follows of several embodiments of an electrostatic coating product spraying device according to its principles, given uniquely by way of example and presented with reference to the attached Figures.

DESCRIPTION OF THE PREFERRED EMBODIMENTS

Figure 1:
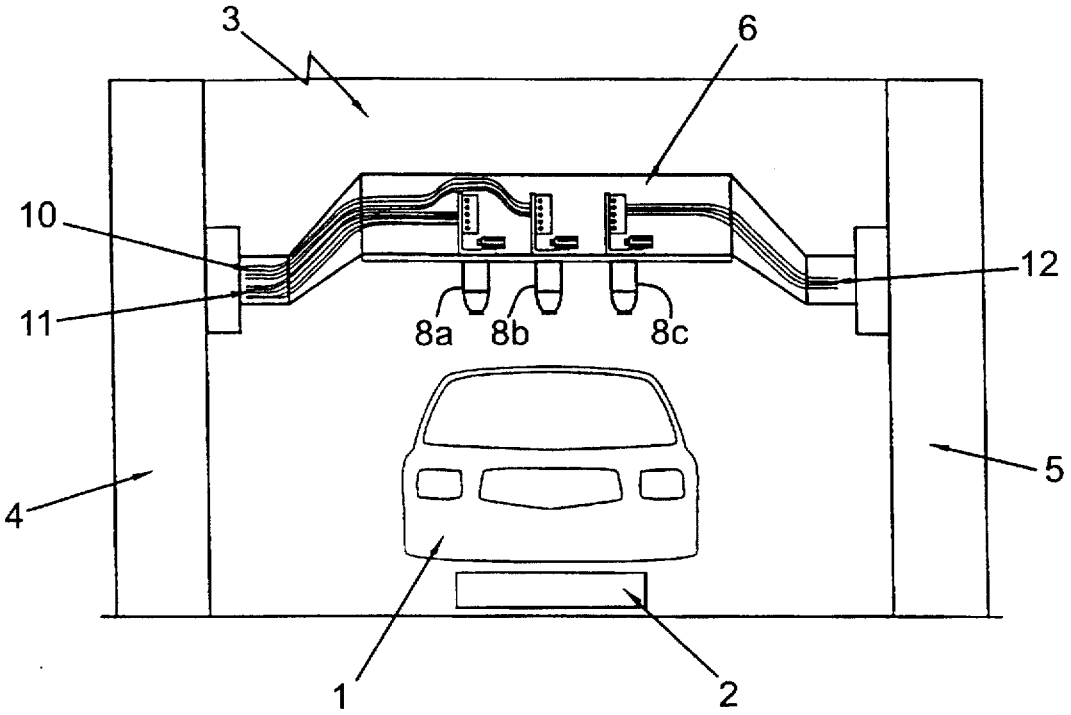
Prior Art Fig. 1
FIG. 1 is a front elevational pictorial view of a roof machine of an electrostatic coating product spraying installation.

The installation shown in FIG. 1 is intended for coating automotive vehicle bodies 1 carried by a conveyor within a booth 3, the installation comprising several lateral machines (not shown) and a roof machine constituted essentially by two stands 4 and 5 capable of displacing a beam 6 above the bodies. Beam 6 carries three electrostatic sprayers 8*a*, 8*b* and 8*c* supplied with a coating product, entrainment air and/or controlling air and an electric current via conduits and cables connected in bundles 10, 11 and 12.

Figure 2:
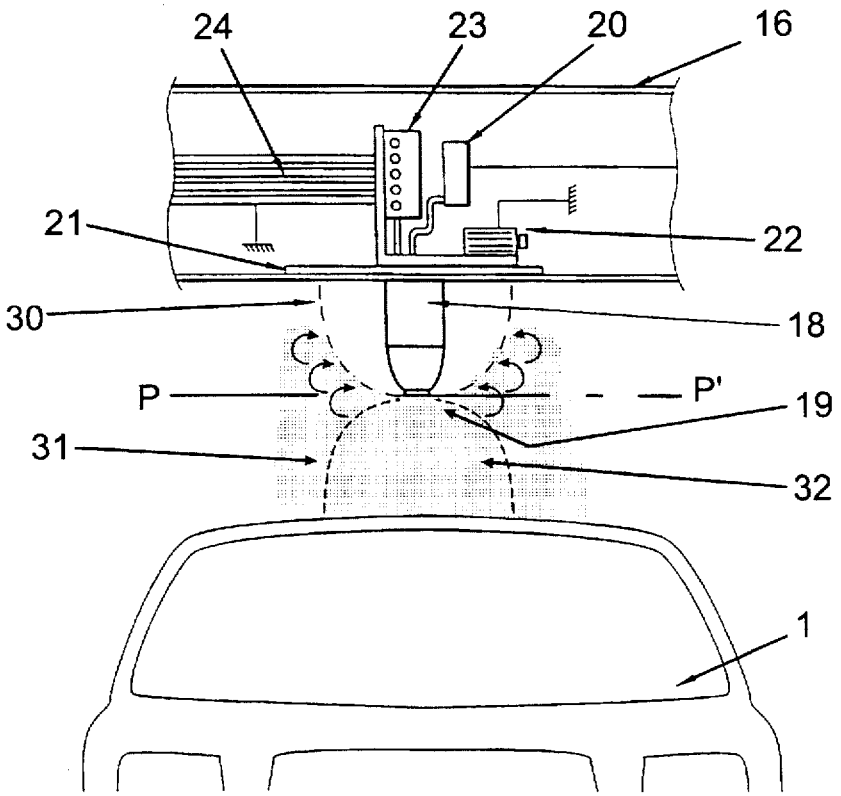
Prior Art Fig. 2
FIG. 2 is a pictorial front elevational view of an electrostatic spraying device including internally charged sprayers carried by a beam of a roof machine according to the prior art.

The beam 16 shown in FIG. 2 corresponds to the prior art. It supports a rotary electrostatic sprayer 18 having a bowl 19 which is brought to a high voltage, for example −60 Kilovolts (kV) by a high voltage unit 20 housed in beam 16. Sprayer 18 is capable of undergoing sweeping movements parallel to the longitudinal axis of beam 16, being moved along rails 21 by means of an electric motor 22. A coating product changing block 23 to which is connected a bundle of tubes 24 for supplying different colored coating products is housed in beam 16 and permits feeding of the sprayer with a coating product of the desired color. Elements 20 to 24 are maintained at ground potential. The plane P-P' in which is located the edge of bowl 19 is an equipotential plane at −60 kV. Electrostatic field lines 30 and 31 from bowl 19 are directed toward the closest grounded objects, i.e. body 1 on the one hand and elements 20–24 on the other hand.

It thus appears that, when a particle of coating product is situated between plane P-P' and beam 16, it is subjected to an electrostatic force which entrains it in the direction of elements 20 to 24 and thus leads it to be deposited on beam 16. Particles coming from the coating product particle cloud 32 necessarily pass above plane P-P' due to disturbances in the flow of air around sprayer 18 as a result of movements of beam 16 above body 1 and as a result of the ventilator effect of the sprayers which are in general three or four in number on beam 16.

In addition, when beam 16 is made of an electrical insulating material or when it is furnished with hoods made of an electrical insulating material, electric charges of opposite polarity to that of the potential of bowl 16 are distributed on the surface of beam 16. In effect, the space between bowl 19 and beam 16 or between bowl 19 and body 1 forms a capacitor in the air and charges of opposite polarity appear, due to electromagnetic influence charging, at the terminals of this capacitor. The insulating surface of the beam cannot dissipate the positive charges which thus remain at its surface.

If a negatively charged particle of coating product is entrained between plane P-P' and beam 16, it is subjected to the effect of the electrostatic field since, when it is in proximity to beam 16, it is attracted by the positive charges at the surface of beam 16.

The causes of soiling of beam 16 are thus multiple.

Figure 3:
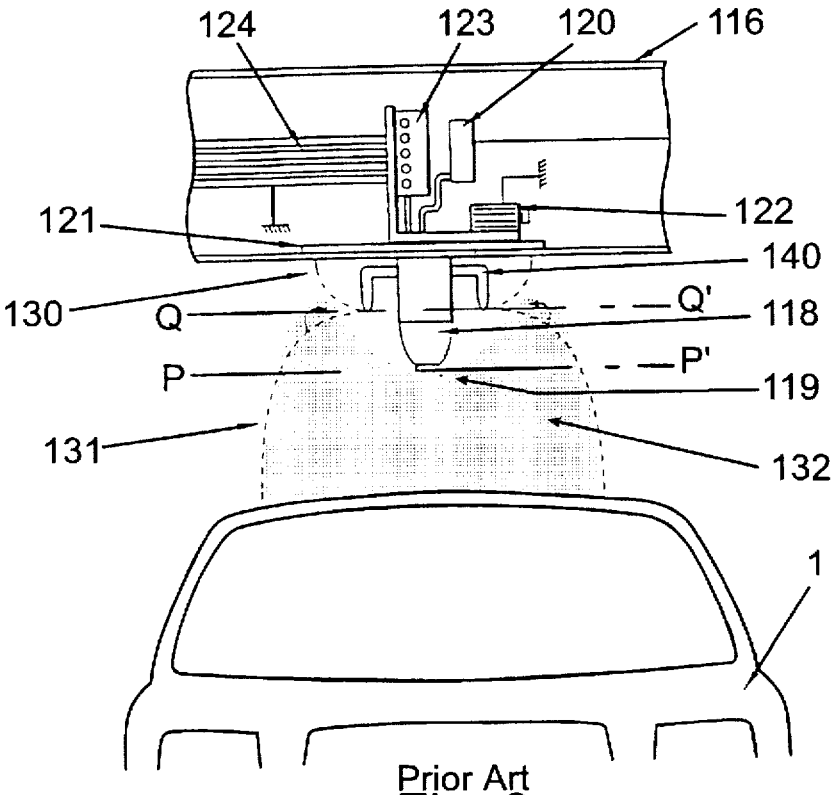
Prior Art Fig. 3
FIG. 3 is a view similar to that of FIG. 2 of a device having externally charged sprayers.

The device of FIG. 3 differs from that of FIG. 2 in that the sprayer is provided with electrodes 140 brought to a high voltage. Elements identical or similar to those of FIG. 2 have the same reference numerals increased by 100. A plane Q-Q' containing the tips of electrodes 140 is thus an equipotential plane.

When bowl 119 is not brought to a high voltage, for example during spraying of conductive coating products such as water soluble paints, charging of cloud 132 is effectuated solely by electrodes 140. As is seen in FIG. 3, certain particles which are entrained between plane Q-Q' and beam 116 are displaced toward elements 120 to 124 and are deposited on beam 116.

When bowl 119 is also brought to the high voltage, the plane P-P' is also an equipotential plane; electrodes 140 are then counterelectrodes brought to a potential of the same polarity as that of bowl 119 and serving to repel paint particles toward the object to be coated. However, when a particle is between plane Q-Q' and beam 116, it is led toward beam 116 as described previously. It is to be noted that, the distance between plane Q-Q' and beam 116 being smaller than that between plane P-P' and beam 116, the electrostatic field between electrodes 140 and beam 116 has, when electrodes 140 and bowl 119 are at the same potential, an intensity greater than that between bowl 119 and beam 116. In the case where electrodes 140 are replaced by electrodes placed at the surface of beam 116, the situation is similar. In this latter case, the high voltage has in addition a tendency to produce a glow discharge from the electrodes toward elements 120–124, which has the result of electrically charging elements 120–124.

The phenomenon of accumulation of positive charges at the insulating surface of a beam takes place in the same manner as in the case of the device of FIG. 2 and produces the same effects of attraction of charged particles.

Figure 4:
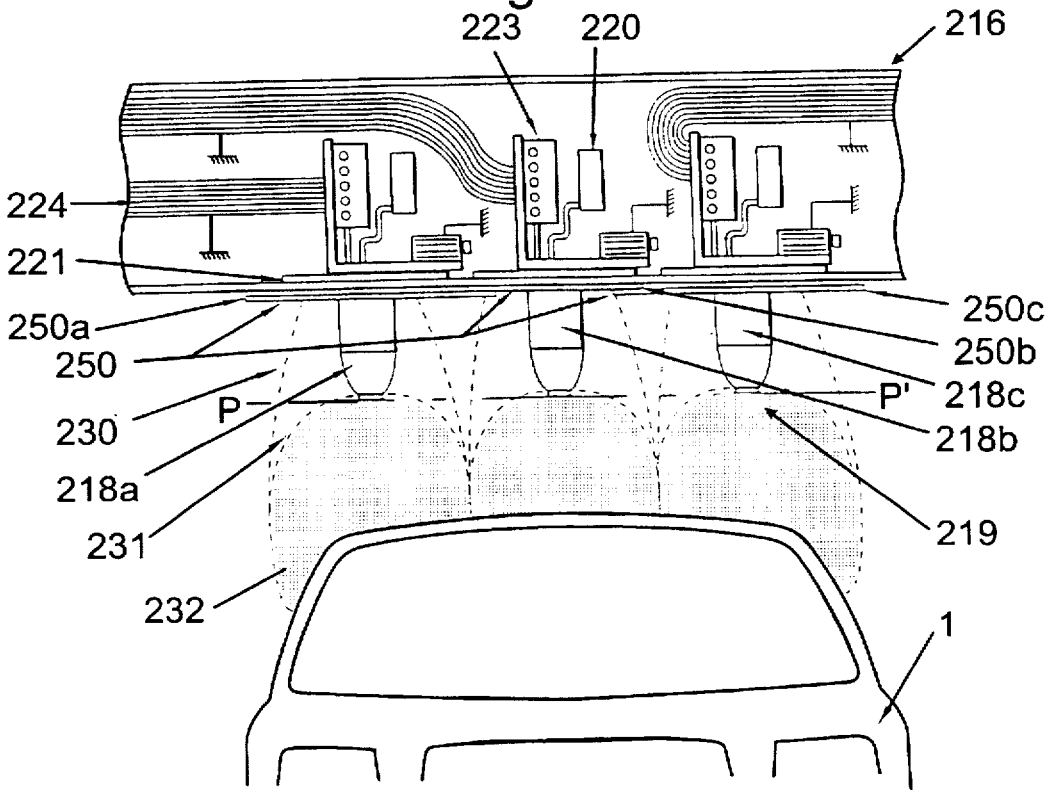
FIG. 4 is a view similar to that of FIG. 3 showing sprayers of a device according to the invention.
Figure 5:
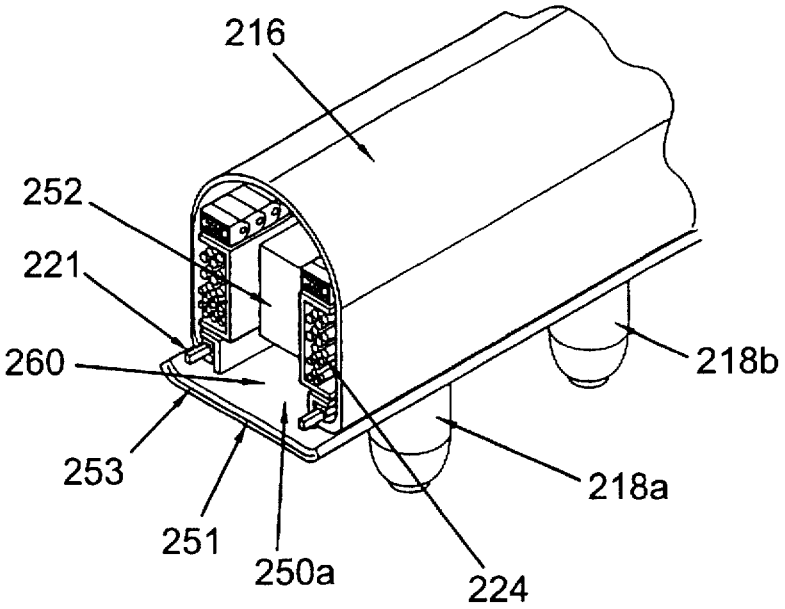
FIG. 5 is a perspective view of a portion of the beam of FIG. 4.

The device according to the invention shown in FIGS. 4 and 5 differs from those already described in that it comprises an electrostatic shield 250. Elements similar or identical to those of FIG. 2 carry the same reference numerals increased by 200. Electrostatic shield 250 is constituted by several panels 250*a*, 250*b*, 250*c* mounted at the lower part of beam 216. Each panel is constituted by a conductive plate 251 (FIG. 5) electrically connected to a high voltage unit 252, conductive plate 251 being covered on all of its faces by a layer 253 of insulating resin, for example PVC. An electric connection to plate 251 extends through layer 253.

The potential of plate 251 permits creation of an electrostatic field between the lower part of beam 216 and body 1 which, if the potential applied to plate 251 is of the same polarity as that applied to bowl 219, extends in a parallel direction in the same polarity sense as that established between bowl 219 and body 1. Thus, the effect of the two fields is cumulative between bowl 219 and body 1 and is compensated, or neutralized, between bowl 219 and beam 216.

If the potential applied to plate 251 of shield 250 is greater in absolute value than that applied to bowl 219, it is even possible to reverse the polarity sense of the electrostatic field between plane P-P' and beam 216 with respect to that existing in the arrangements shown in FIGS. 2 and 3. Thus, when bowl 219 is brought to a potential of −60 kV, one can bring plate 251 of one or more of panels 250*a*, etc. to a potential of −80 kV and produce an additive effect of the electric fields.

A capacitor is formed between shield 250 and bowl 219. When bowl 219 is at −60 kV and shield 150 is at −80 kV, bowl 219 has a positive potential relative to that of the shield. The distribution of charge is thus the inverse of that in the prior art arrangement of FIG. 2, so that negative charges appear at the surface of shield 250 and remain there since the outer surface of shield 250 is of insulating material. These negative charges repel coating product particles emanating from cloud 232, which particles are negatively charged and would have a tendency to approach the surface of beam 216 despite the electrostatic field. The effects of the electrostatic field and the surface charges of shield 250 thus combine to prevent soiling of the surface of beam 216.

However, this relation between the potentials of the bowl and the shield is not indispensable. In effect, even if the potential of shield 250 has an absolute value lower than that of the potential of bowl 219, the electrostatic field between plane P-P' and shield 250 is much weaker than that established with the arrangement shown in FIGS. 2 and 3 and the aerodynamic forces communicated to cloud 232 by the sprayer are thus sufficient to direct the bulk of the product particles toward body 1.

In addition, the phenomenon of negative surface charge of the surface of the shield appears even when the potential of the shield has an absolute value which is less than that of the electrostatic charging means. In effect, the environment of the shield includes the spray booth, such as booth 3 of FIG. 1, and body 1 which are at ground potential. Positive charges appear at the surface of these objects and negative charges appear at the surface of shield 250. Negatively charged particles of the coating product are thus also repelled in this case.

A screen, or grill, could be substituted for each plate 251, which would permit the weight of the shield to be reduced. Such screen, or grill, could be coated with an insulating resin.

As can be seen in FIG. 4, panels 250*a*, 250*b* and 250*c* constituting shield 250 are each fixed to a respective one of sprayers 218*a*, 218*b* and 218*c* and move with the respective sprayers during their sweeping movements. Panels 250*a*, 250*b* and 250*c* can partially overlap one another in order to create a continuous shield regardless of the relative positions of sprayers 218*a*, 218*b* and 218*c*. Panels 250*a* to 250*c* have a form adapted to cover the major part of the surface of beam 216 which would be visible from the location of one of the sprayers. In particular, panels 250*a* to 250*c* cover an opening 260 formed in the bottom of beam 216 in order to permit the sweeping movement of the sprayers on rails 221. The panels thus cover the longitudinal distance situated between two adjacent sprayers, this region being in a region of maximum aerodynamic turbulence due to the combined influence of two sprayers. Thus, the shield extends over substantially the entire length of the beam and the protected zone is not limited to that which is adjacent the sprayers, but includes substantially the entire beam, this including the zone where the beam is the most susceptible to being soiled by coating particles.

Due to the structure of shield 250, comprising at least one conductive plate covered with an insulating material, it is possible to place shield 250 in contact with beam 216, even at the interior of the beam, without danger that glow discharges from the plate forming part of the shield will electrically charge elements 220 to 224 or disturb the operation of associated measuring or calculation cells. In effect, even though the electrostatic field 230 is established through layer 253 of insulating material, electric charge will not pass through such a material; it can thus not be transmitted to neighboring equipment. In addition, no current is supplied from plate 251 because it is completely insulated from the adjacent masses. It is thus possible to supply the three plates corresponding to the three panels 250*a*, 250*b* and 250*c* from a single high voltage unit 252 which has a relatively low power consumption.

Taking into account that which has been described above, shield 250 can be placed in contact with beam 216, i.e. integrated with its profile and does not disturb the flow of air around the beam and its sprayers; it thus has little tendency to become soiled by aerodynamic effects. If the shield is housed in the structure, whether this structure is represented by a beam or an arm of a lateral machine, it is completely protected against soiling.

Figure 6:
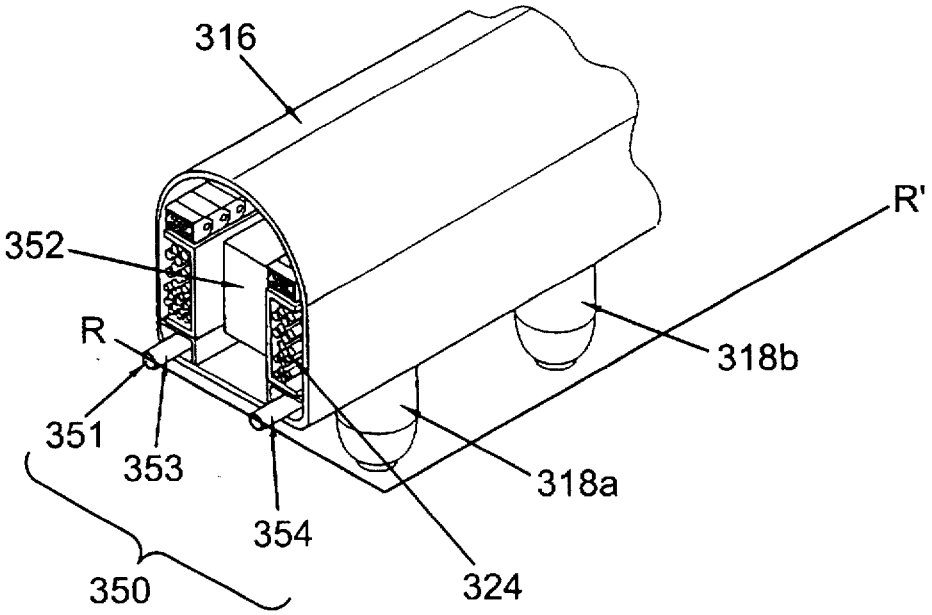
FIG. 6 is a view similar to that of FIG. 5, showing another embodiment of the beam.

In another embodiment of the shield shown in FIG. 6, shield 350 is composed of tubes 353 and 354 made of insulating material and filled with an electrically conductive liquid 351 such as water with suitable additives or a conductive gel. The liquid is connected to a high voltage unit 352 by a connector (not shown). Each tube 353 or 354 is housed at the interior of beam 316 in a channel or cavity in the framework of the beam. Each tube 353 and 354 extends along substantially the entire length of the beam. Possibly, the tubes 353 and 354 can be connected in a manner to form a loop. The electrostatic effect of these tubes 353 and 354 is the same as that of panels 250, 250*b* and 250*c* described with reference to FIGS. 4 and 5. In effect, tubes 353 and 354 constitute a Faraday cage which induces a quasi-equipotential line in a plane R-R' containing the longitudinal axes of tubes 353 and 354. The particles of coating product are thus repelled by the electrostatic field toward the body 1 as described previously.

In addition, the phenomenon of negative charging of the surface of the beam occurs as in the embodiment of FIGS. 4 and 5. The negatively charged particles are thus also repelled by the surface charge of the beam.

In another form of construction of the invention, which is not shown, each tube 353 and 354 can be replaced by a bundle of small diameter pipes or tubing, with the total cross section of each bundle corresponding approximately to that of the corresponding channel in which the bundle is disposed. Such a bundle presents the additional advantage that it is easier to install in a channel due to the flexibility of the smaller diameter pipes.

Another form of construction according to the invention consists in replacing the tubes or pipes mentioned above by one or several electric cables sheathed in an insulating material and connected to a high voltage source. They can be disposed in a loop or a serpentine, i.e. forming several back and forth branches along the length of the beam. The electrostatic effect obtained is the same as with shield 350 described with reference to FIG. 6 above.

The electrostatic shield according to the invention can also be created by metallization of one of the surfaces of the support structure, for example the framework of beam 116 or one of its protection hoods. The metallized layer is then covered with a layer of an insulating material such as an alkyd varnish, which permits placing it in the neighborhood of objects at ground potential. As seen previously, the metallic layer is brought to a high voltage by a suitable high voltage supply unit.

Finally, in the case of a support structure whose framework is of insulating material, such as for example a beam made of fiberglass resin, the shield can be formed by inserting a bar or an electrical conductor having any other form at the interior of a closed cavity in the framework. The bar is electrically insulated from adjacent objects which must remain at ground potential due to the insulating character of the structure. The bar can be connected in an appropriate manner to an appropriate high voltage source through a high voltage shaft as is known in the art.

Figure 7:
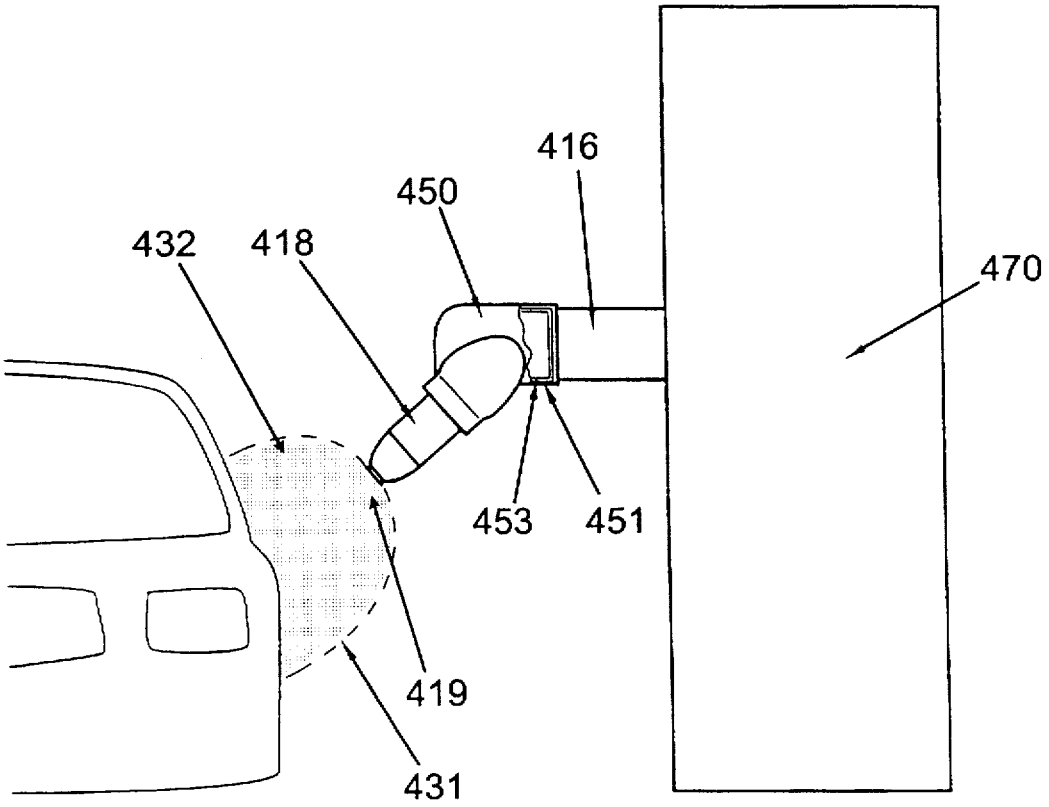
FIG. 7 is a pictorial front elevational view of a portion of a lateral machine according to the invention for an electrostatic coating product spraying installation.

The lateral machine 470 shown in FIG. 7 results from another application of the invention. An arm 416 of this machine is equipped with an electrostatic shield 450 constituted by a conductive plate 451 of suitable form embedded in an insulating plate 453. Electrostatic shield 450 constitutes in effect a hood for arm 416. Arm 416 carries an electrostatic sprayer 418 and, as in the case of the previous embodiments, includes means producing an electrostatic field having field lines 431 and emits a cloud 432 of coating product particles.

The embodiments described above with respect to a beam of a roof machine are readily adaptable to a lateral machine, and particularly the arm of a lateral machine.

Of course, all of the types of shields described above can be combined, in which case their effects would be cumulative. They all offer the benefits of the effect of the electrostatic field and of the effect of the surface charges. The numerical values for electrostatic potentials given above, i.e. 60 and 80 kV, are given solely by way of example and any value known to one skilled in the art is compatible with the purposes of the invention.

The invention has been described with reference to rotary coating product sprayers. However, it is equally applicable to pneumatic sprayers and sprayers utilizing an internal charging or an external charging. Similarly, the invention, although presented with reference to an insulating support structure can be utilized with a conductive support structure maintained at ground potential and carrying an electrostatic shield.

This application relates to subject matter disclosed in French Application number 95 03447, filed on Mar. 20, 1995, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An electrostatic coating product spraying device for spraying a coating product onto an object, said spraying device comprising:

at least one sprayer having electrostatic charging means supplying a high voltage of a first polarity and potential for electrostatically charging the coating product, said electrostatic charging means producing a first electrostatic field which extends in a direction between said electrostatic charging means and the object;

a movable support structure supporting said at least one sprayer;

components carried by said movable support structure for feeding coating product to said at least one sprayer and for moving said at least one sprayer, said components being at ground potential;

an electrostatic shield positioned and arranged at a location such that said electrostatic charging means are disposed between said electrostatic shield and the object; and means connected to said electrostatic shield for maintaining said electrostatic shield at an electrostatic potential having the first polarity, thus producing a second electrostatic field extends from said electrostatic shield to the object substantially in parallel with, and in the same polarity sense as, the first electrostatic field.

2. The device as define in claim 1 wherein said electrostatic shield is disposed entirely to one side of said electrostatic charging means and the object to be coated is disposed, during coating, entirely to second said of said electrostatic charging means, in which the second side opposite to the first side.

3. The device as defined in claim 1 wherein said support structure comprises a beam of roof machine.

4. The device as defined in claim 1 wherein said shield extends along substantially the entirety of the length of said beam.

5. The device as defined in claim 1 wherein said support structure is an arm of a lateral machine.

6. The device as defined in claim 1 wherein said electrostatic shield is maintained at an electrostatic potential has an absolute value at least equal to the absolute value of the potential provided by said charging means.

7. The device as defined in claim 1 wherein said support structure is a beam of a roof machine and said electrostatic shield comprises a layer of conductive material deposited on one surface of said beam.

8. The device as defined in claim 1 wherein said support structure is a beam of a roof machine, said beam comprises an electrically insulating framework having at least one closed cavity, and said electrostatic shield comprises a conductive element inserted into said cavity.

9. The device as defined in claim 1 wherein said support structure is an arm of a lateral machine and said electrostatic shield is formed to constitute a hood covering said arm.

10. The device as defined in claim 1 wherein said electrostatic shield comprises an electrically conductive element connected to a high voltage generator, and a layer of insulating material substantially covering said electrically conductive element.

11. The device as defined in claim 10 wherein said electrically conductive element is an element selected from the group consisting of a plate, a screen, a plurality of electric cables and a metal bar.

12. The device as defined in claim 10 wherein said electrically conductive element comprises a mass of fluid and said electrostatic shield further comprises at least one conduit containing said mass of fluid.

13. The device as defined in claim 12 wherein said at least one conduit comprises a tube of insulating material.

14. The device as defined in claim 12 wherein said at least one conduit comprises a bundle of tubes of insulating material.

15. In a coating machine for applying a coating to automotive vehicle bodies including at least one sprayer having electrostatic charging means supplying a high voltage of a first polarity and potential for electrostatically charging a coating product, said electrostatic charging means producing a first electrostatic field which extends in a direction between said electrostatic charging means and the object, a movable support structure supporting said at least one sprayer, components carried by said movable support structure for feeing coating product to said at least one sprayer and for moving said at least one sprayer, said components being at ground potential; wherein the improvement comprises an electrostatic shield positioned and arranged at a location such that said electrocharging means are disposed between said electrostatic shield and the object; and means connected to said electrostatic shield for maintaining said electrostatic shield at an electrostatic potential having the first polarity, thus producing a second electrostatic field which extends from said electrostatic shield to the object substantially in parallel with, and in the same polarity sense as, the first electrostatic field.

* * * * *